US006568225B1

(12) United States Patent
Chang

(10) Patent No.: US 6,568,225 B1
(45) Date of Patent: May 27, 2003

(54) THEFTPROOF LOCK DEVICE FOR A SUITCASE

(76) Inventor: Hung-yi Chang, No. 336, Cheng-Kung Rd., Feng Yuan, Taichung, Hsien (TW)

( * ) Notice: Subject to any disclaimer, the term of this patent is extended or adjusted under 35 U.S.C. 154(b) by 0 days.

(21) Appl. No.: 10/077,845

(22) Filed: Feb. 20, 2002

(51) Int. Cl.[7] ..... A45C 13/10; E05B 65/32

(52) U.S. Cl. ..... 70/69; 70/DIG. 49; 70/67; 70/441; 70/333 R

(58) Field of Search ..... 70/57.1, 67, 69–71, 70/278.4, 278.5, 33 BR, 439, 441, DIG. 49, 312, 318

(56) References Cited

U.S. PATENT DOCUMENTS 4,198,837 A * 4/1980 Gisiger ..... 70/71
4,541,260 A * 9/1985 Rubinstein et al. ..... 70/425
4,682,483 A * 7/1987 Werner ..... 70/312
5,211,040 A * 5/1993 Gisiger ..... 70/71
5,237,842 A * 8/1993 Rasch et al. ..... 70/285
5,557,954 A * 9/1996 Ling ..... 70/68
5,689,979 A * 11/1997 Yu ..... 70/69
5,692,403 A * 12/1997 Ling ..... 70/312
5,713,226 A * 2/1998 Yu ..... 70/69
5,856,782 A * 1/1999 Sasagawa et al. ..... 340/572.9
5,864,290 A * 1/1999 Toyomi et al. ..... 340/572.9
5,906,124 A * 5/1999 Su ..... 70/312
5,927,110 A * 7/1999 Yu ..... 70/68
5,927,113 A * 7/1999 Yu ..... 70/312
6,016,675 A * 1/2000 Te ..... 70/312
6,173,592 B1 * 1/2001 Yu ..... 70/69
6,357,265 B1 * 3/2002 Chang ..... 70/25
6,412,316 B1 * 7/2002 Buss ..... 70/69

* cited by examiner

*Primary Examiner*—Anthony Knight
*Assistant Examiner*—John B. Walsh
(74) *Attorney, Agent, or Firm*—Rosenberg, Klein & Lee

(57) ABSTRACT

A theftproof lock device for a suitcase includes a housing, and a closure plate mounted on an opened side of the housing, and further includes multiple number wheel sets, two opposite press members, a drive plate, a slide, and a circuit board each mounted between the housing and the closure plate. Thus, the number wheel of the number wheel set for controlling the alarm may be rotated to an erroneous position, so as to start the alarm easily, thereby providing a theftproof effect. In addition, the number wheel of the number wheel set for controlling the alarm may be rotated to a correct position, thereby closing the alarm.

5 Claims, 7 Drawing Sheets

THEFTPROOF LOCK DEVICE FOR A SUITCASE

BACKGROUND OF THE INVENTION

1. Field of the Invention

The present invention relates to a theftproof lock device for a suitcase, and more particularly to a theftproof lock device for a suitcase, wherein the number wheel of the number wheel set for controlling the alarm may be rotated to an erroneous position, so as to start the alarm easily, thereby providing a theftproof effect.

2. Description of the Related Art

The closest prior art of which the applicant is aware is disclosed in his U.S. Pat. No. 6,357,265.

A conventional lock device for a suitcase in accordance with the prior art shown can be used to lock the suitcase, thereby preventing the suitcase from being opened by any person easily. However, the conventional lock device for a suitcase cannot provide a theftproof effect, so that it is easily stolen by an intentional person.

SUMMARY OF THE INVENTION

The present invention has arisen to mitigate and/or obviate the disadvantage of the conventional lock device for a suitcase.

The primary objective of the present invention is to provide a theftproof lock device for a suitcase, wherein the number wheel of the number wheel set for controlling the alarm may be rotated to an erroneous position, so as to start the alarm easily, thereby providing a theftproof effect.

Another objective of the present invention is to provide a theftproof lock device for a suitcase, wherein the number wheel of the number wheel set for controlling the alarm may be rotated to a correct position, thereby closing the alarm.

In accordance with the present invention, there is provided a theftproof lock device for a suitcase, comprising a housing, a closure plate mounted on an opened side of the housing, and further comprising multiple number wheel sets, two opposite press members, a drive plate, a slide, and a circuit board each mounted between the housing and the closure plate, wherein:

the circuit board is secured on one side of the closure plate, and is provided with at least one number switch which includes a first conductive plate and a second conductive plate, the at least one number switch is connected with a switch conductive plate set which is electrically connected with an alarm; and the housing has an upper portion for receiving the two opposite press members, the slide is movably mounted between the two opposite press members, the housing has a lower portion provided with multiple protruding shafts for mounting the multiple number wheel sets, each of the multiple number wheel sets includes a number wheel and a control wheel in turn mounted on a respective one of the multiple protruding shafts of the housing, the control wheel has a first side formed with multiple cavities, the number wheel is provided with multiple bosses that may be inserted into and locked in the multiple cavities of the control wheel, so that the number wheel may drive the control wheel to rotate, the control wheel has a second side provided with a spring which is rested on the first conductive plate of the number switch of the circuit board, the second side of the control wheel is provided with a boss that may contact the second conductive plate of the number switch of the circuit board, the boss is conducted with the spring, the control wheel has an outer periphery formed with a breach located opposite to the boss, the drive plate is mounted between the multiple number wheel sets and the closure plate, the drive plate is formed with multiple oblong slots for receiving the multiple control wheels of the multiple number wheel sets, and each of the multiple oblong slots of the drive plate is provided with a lug that may be inserted into and locked in the breach of the respective control wheel.

Further benefits and advantages of the present invention will become apparent after a careful reading of the detailed description with appropriate reference to the accompanying drawings.

DETAILED DESCRIPTION OF THE INVENTION

Figure 1:
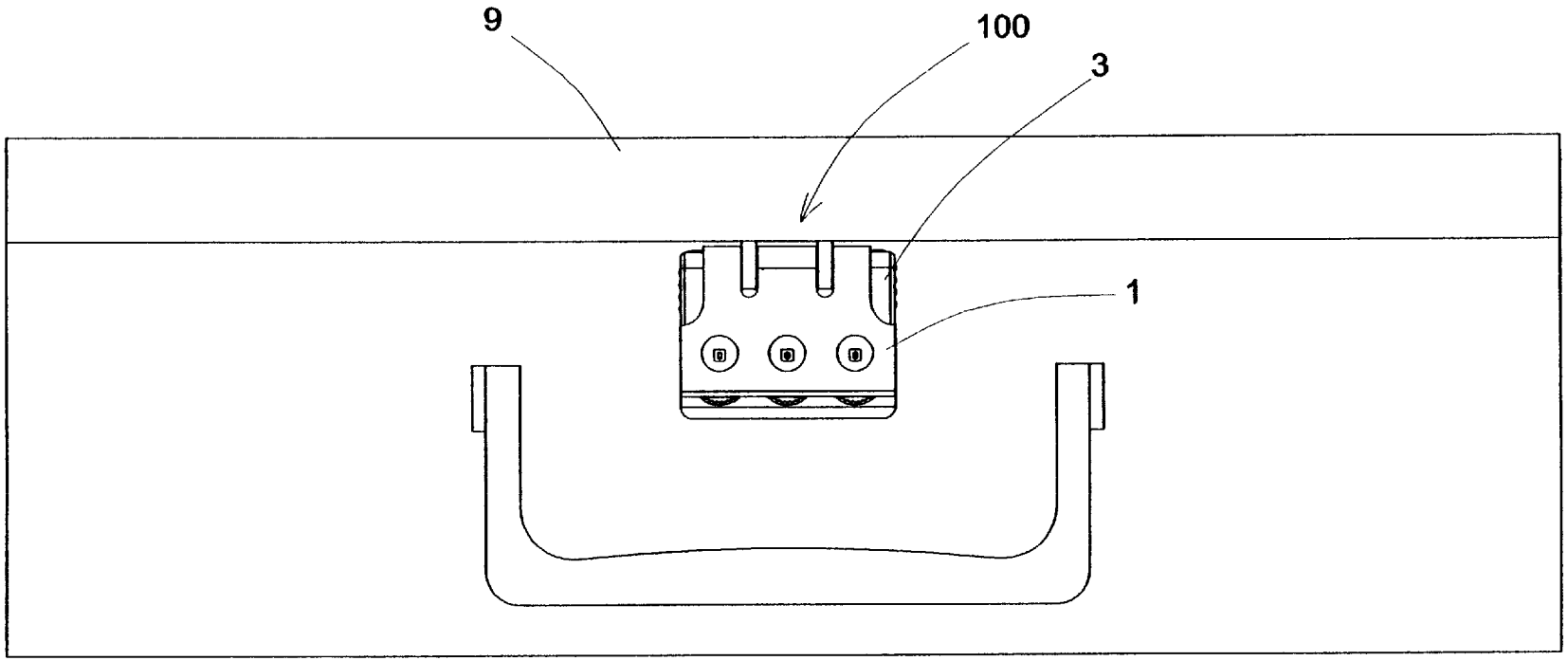
FIG. 1 is a schematic view of a theftproof lock device for a suitcase in accordance with a preferred embodiment of the present invention.
Figure 2:
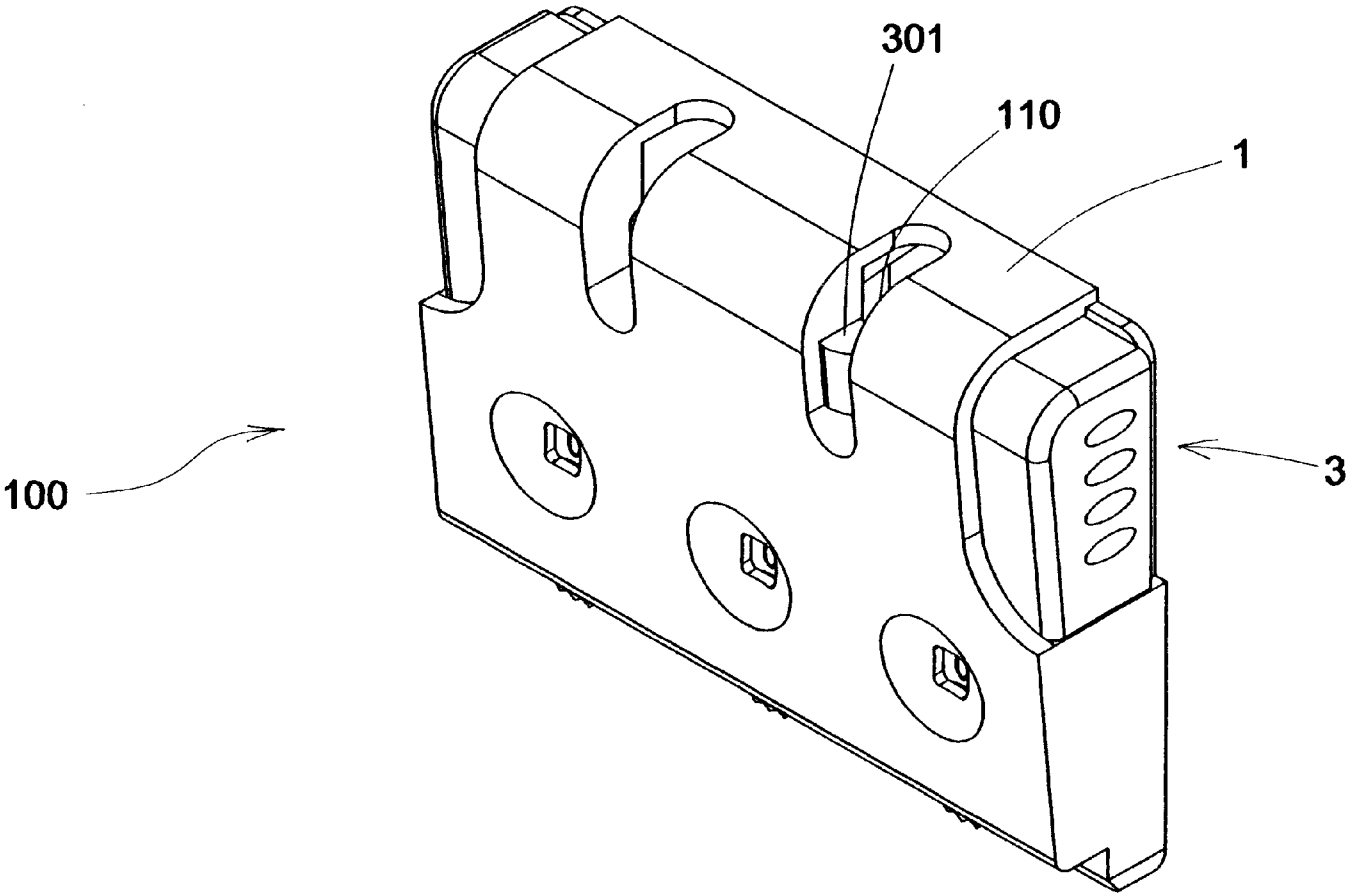
FIG. 2 is a perspective view of a theftproof lock device for a suitcase in accordance with a preferred embodiment of the present invention.
Figure 3:
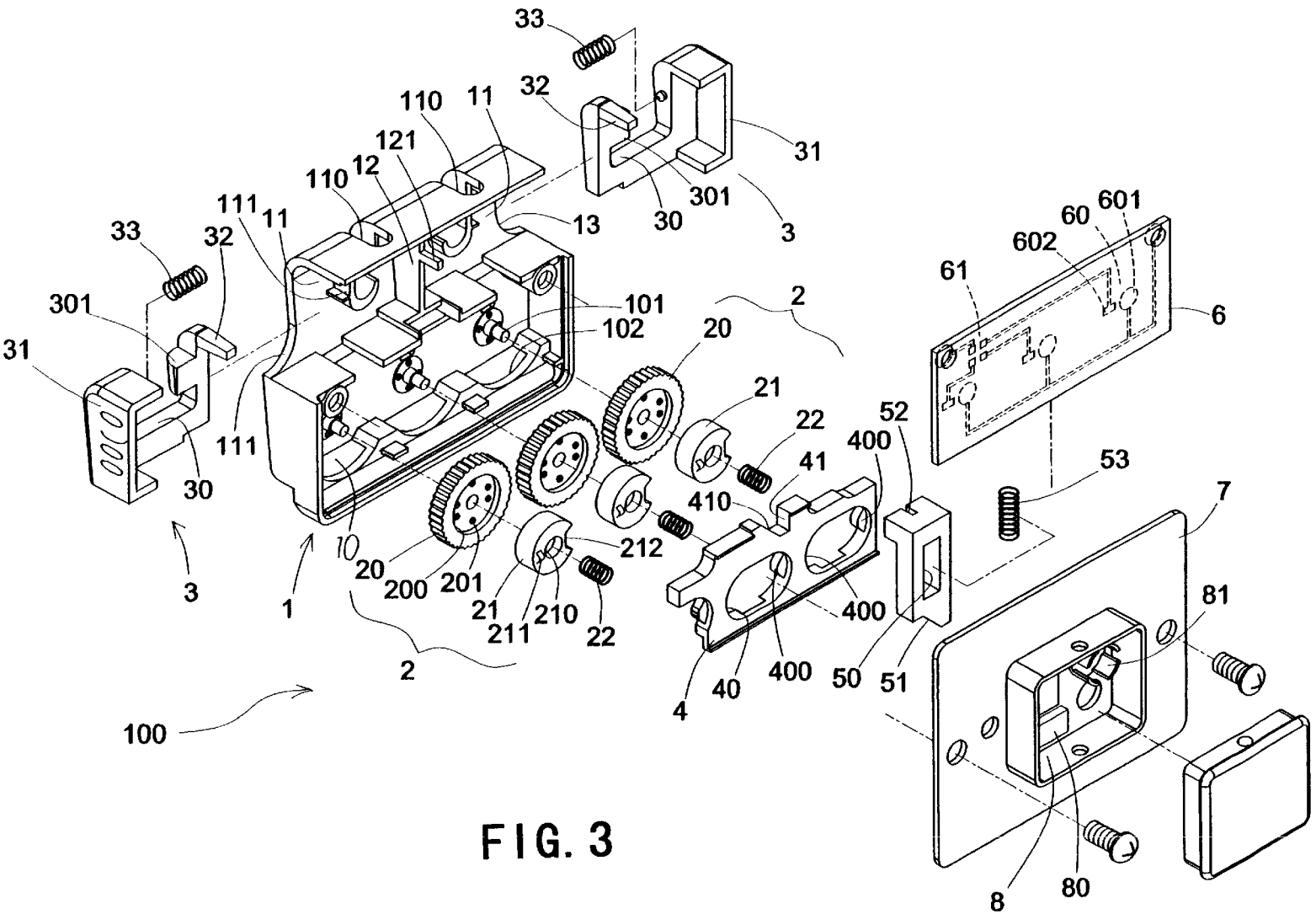
FIG. 3 is an exploded perspective view of the theftproof lock device for a suitcase taken along line 3—3 as shown in FIG. 2.

Referring to the drawings and initially to FIGS. 1–3, a theftproof lock device 100 in accordance with a preferred embodiment of the present invention is available for a suitcase 9, and comprises a housing 1, and a closure plate 7 mounted on an opened side of the housing 1. The theftproof lock device 100 further comprises multiple number wheel sets 2, two opposite press members 3, a drive plate 4, a slide 5, and a circuit board 6 each mounted between the housing 1 and the closure plate 7.

The circuit board 6 is secured on one side of the closure plate 7, and is provided with multiple number switches 60 each including a first conductive plate 601 and a second conductive plate 602. Each of the multiple number switches 60 is connected with a switch conductive plate set 61 which is electrically connected with an alarm 8 which is provided with a vibration switch 80 and a battery 81.

As shown in FIG. 3, the housing 1 has an upper portion formed with two opposite first receiving spaces 11 and a lower portion formed with a second receiving space 10. The upper portion of the housing 1 is provided with a longitudinal baffle 12 located between the two opposite first receiving spaces 11. The longitudinal baffle 12 is provided with a catch bar 121 protruding outward. Each of the two opposite first receiving spaces 11 of the housing 1 has an outer side formed with a press breach 13. The housing 1 has a top formed with two spaced insertion trenches 110 each extending downward and each communicating with a respective one of the two opposite first receiving spaces 11. Each of the two opposite first receiving spaces 11 of the housing 1 has an inner side provided with a catch plate 111 aligning with a respective one of the two spaced insertion trenches 110.

Each of the two opposite press members 3 is movably mounted in a respective one of the two opposite first receiving spaces 11 of the housing 1, and is formed with a slot 30 for receiving the catch plate 111. Each of the two opposite press members 3 has a first side provided with a press portion 31, and a second side provided with a locking hook 301 that may be locked in the catch plate 111 to close the respective insertion trench 110 of the housing 1. The second side of each of the two opposite press members 3 is provided with a protruding bar 32 extending outward.

Each of the two opposite press members 3 is provided with a spring 33 mounted between a wall of the slot 30 and the catch plate 111, so that the locking hook 301 of each of the two opposite press members 3 is normally locked in the catch plate 111 to close the respective insertion trench 110 of the housing 1, thereby forming a locking state.

The second receiving space 10 of the housing 1 is provided with multiple protruding shafts 101, and multiple breaches 102 located under the multiple protruding shafts 101.

Figure 4:
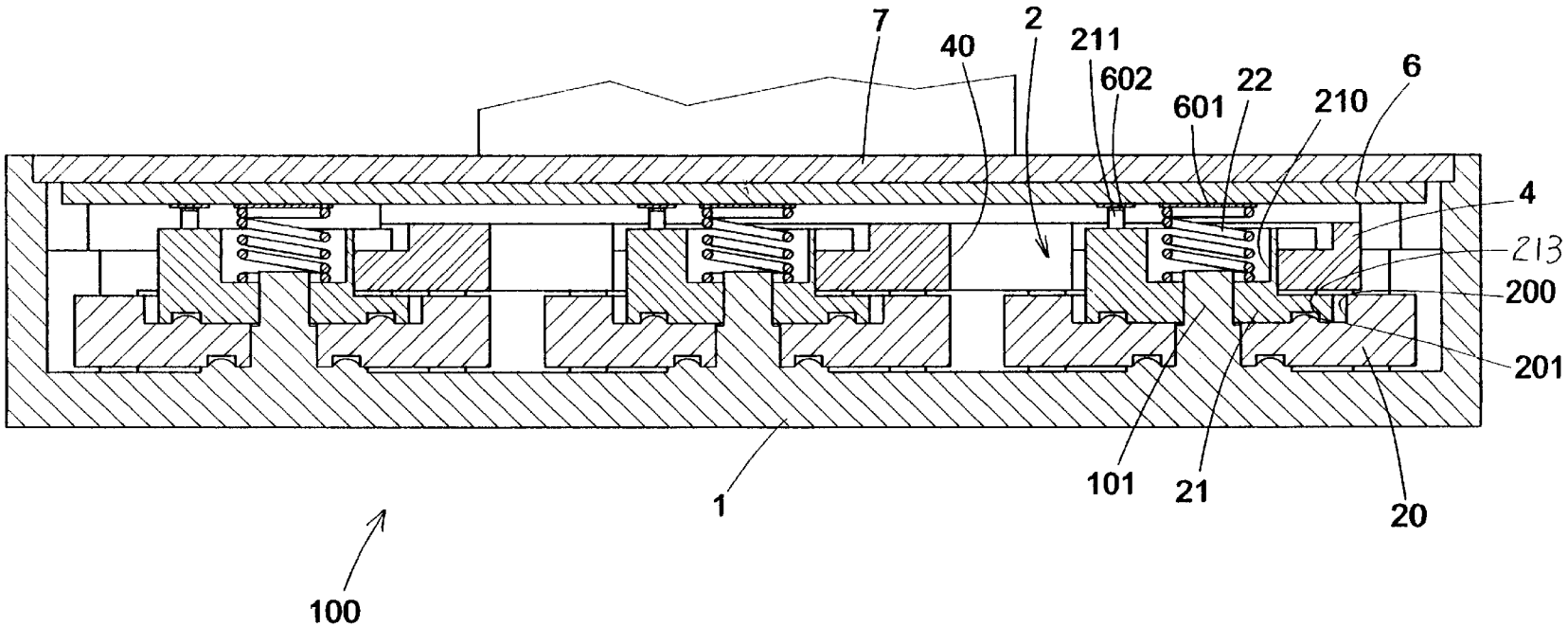
FIG. 4 is a top plan cross-sectional view of the theftproof lock device for a suitcase as shown in FIG. 2.

As shown in FIGS. 3 and 4, each of the multiple number wheel sets 2 is mounted on a respective one of the multiple protruding shafts 101. Each of the multiple number wheel sets 2 includes a number wheel 20 and a control wheel 21 in turn mounted on a respective one of the multiple protruding shafts 101 of the second receiving space 10 of the housing 1.

The number wheel 20 has one side formed with a recess 200 for receiving the control wheel 21. The control wheel 21 has a first side formed with multiple cavities 213. The recess 200 of the number wheel 20 is provided with multiple bosses 201 that may be inserted into and locked in the multiple cavities 213 of the control wheel 21, so that the number wheel 20 may drive the control wheel 21 to rotate.

The control wheel 21 has a second side formed with a recess 210 for receiving a spring 22 which is rested on the first conductive plate 601 of the respective number switch 60 of the circuit board 6. The second side of the control wheel 21 is provided with a boss 211 that may contact the second conductive plate 602 of the respective number switch 60 of the circuit board 6. The boss 211 is conducted with the spring 22. The control wheel 21 has an outer periphery formed with a breach 212 located opposite to the boss 211.

As shown in FIG. 3, the drive plate 4 is mounted between the multiple number wheel sets 2 and the closure plate 7. The drive plate 4 is formed with multiple transverse oblong slots 40 for receiving the multiple control wheels 21 of the multiple number wheel sets 2. Each of the multiple transverse oblong slots 40 of the drive plate 4 is provided with a lug 400 that may be inserted into and locked in the breach 212 of the respective control wheel 21. The drive plate 4 has a top formed with a recess 41 that is provided with an inclined face 410.

The slide 5 has a center formed with a passage slot 50 for receiving the catch bar 121 of the baffle 12. A spring 53 is mounted in the passage slot 50, and is urged between the catch bar 121 of the baffle 12 and a bottom face of the passage slot 50. The slide 5 has a top formed with a guide slot 52 for insertion of the baffle 12, and a bottom provided with a wedge 51 that may be inserted into and locked in the recess 41 of the drive plate 4. The slide 5 has two opposite sides that may stop the protruding bar 32 of each of the two opposite press members 3, so that the two opposite press members 3 cannot move, thereby forming a locking state.

Thus, the theftproof lock device 100 in accordance with a preferred embodiment of the present invention is provided with a circuit board 6 that may be connected with each of the multiple number wheel sets 2, and the circuit board 6 is provided with a switch conductive plate set 61, so that the user may use the switch conductive plate set 61 to select either one of the multiple number wheel sets 2 as the code switch of the alarm 8.

Figure 5:
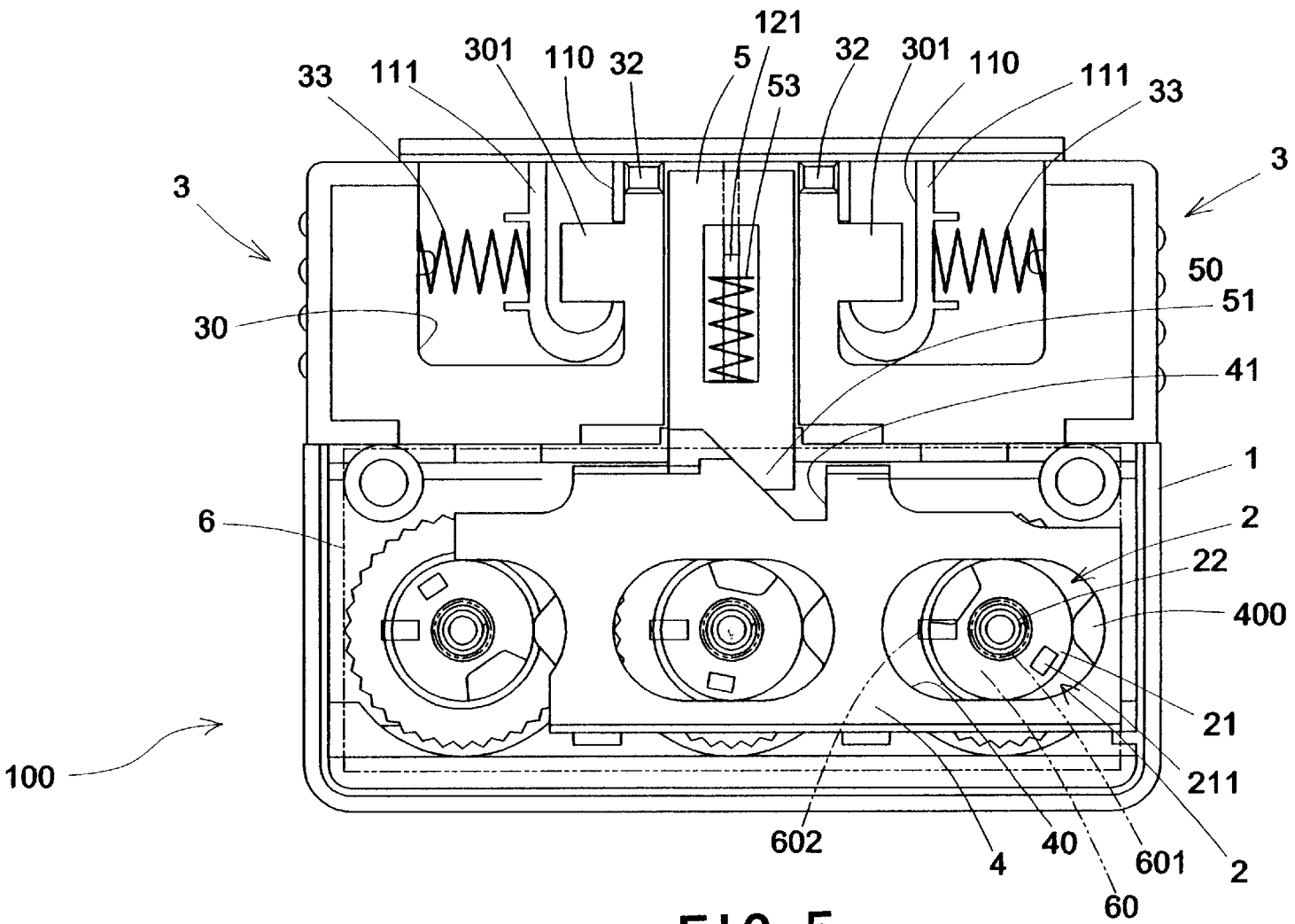
FIG. 5 is a partially cut-away front plan view of the theftproof lock device for a suitcase as shown in FIG. 2.

As shown in FIG. 5, each of the multiple number wheel sets 2 is rotated to an erroneous position, so that the theftproof lock device 100 in accordance with a preferred embodiment of the present invention may be locked.

At this time, the boss 211 of the control wheel 21 is detached from the second conductive plate 602 of the respective number switch 60 of the circuit board 6, while the lug 400 of each of the multiple transverse oblong slots 40 of the drive plate 4 is urged by the outer periphery of the respective control wheel 21, so that the drive plate 4 may be moved sideward. Then, the inclined face 410 of the recess 41 of the drive plate 4 may push the wedge 51 of the slide 5, so that the slide 5 may be moved upward to a determined position as shown in FIG. 5. At this time, the two opposite sides of the slide 5 may stop the protruding bar 32 of each of the two opposite press members 3, so that the two opposite press members 3 cannot move, thereby forming a locking state.

The control wheel 21 is rotated by the number wheel 20, so that the boss 211 of the control wheel 21 may be detached from the second conductive plate 602 of the respective number switch 60 of the circuit board 6, thereby starting the alarm 8. Thus, if the suitcase 9 is moved, the vibration switch 80 of the alarm 8 may be started to buzz, thereby providing a theftproof effect. Thus, the number wheel 20 of the number wheel set 2 for controlling the alarm 8 may be rotated to an erroneous position, so as to start the alarm 8 easily, thereby providing a theftproof effect. In addition, the number wheel 20 of the number wheel set 2 for controlling the alarm 8 may be rotated to a correct position, thereby closing the alarm 8.

Figure 6:
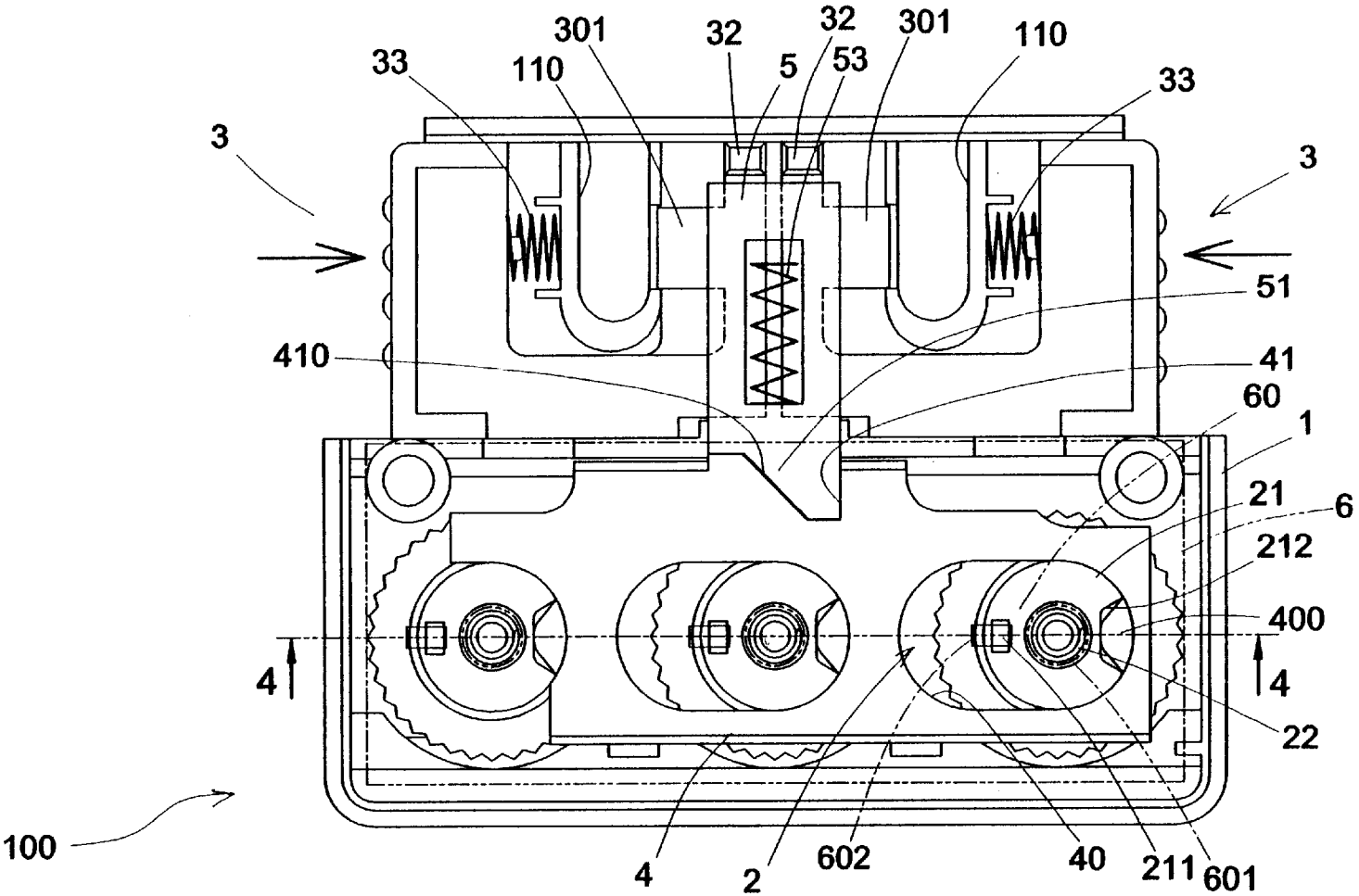
FIG. 6 is a schematic operational view of the theftproof lock device for a suitcase as shown in FIG. 5 in use.

As shown in FIG. 6, the number wheel 20 of each of the multiple number wheel sets 2 is rotated to a correct position, so that the theftproof lock device 100 in accordance with a preferred embodiment of the present invention may be unlocked.

When the number wheel 20 of each of the multiple number wheel sets 2 is rotated to the correct position, the breach 212 of the control number 21 of each of the multiple number wheel sets 2 is rotated to align with the lug 400 of each of the multiple transverse oblong slots 40 of the drive plate 4, while the boss 211 of the control wheel 21 contacts the second conductive plate 602 of the respective number switch 60 of the circuit board 6, thereby closing the alarm 8.

At this time, the slide 5 between the two opposite press members 3 is moved downward by the restoring force of the spring 53, whereby the two opposite sides of the slide 5 may detach from the protruding bar 32 of each of the two opposite press members 3, so that the two opposite press members 3 can move freely, thereby forming an unlocking state. Thus, the two opposite press members 3 may be pressed, to detach the locking hook 301 of each of the two opposite press members 3 from the insertion trench 110 of the housing 1, so that the suitcase 9 may be opened.

Figure 7:
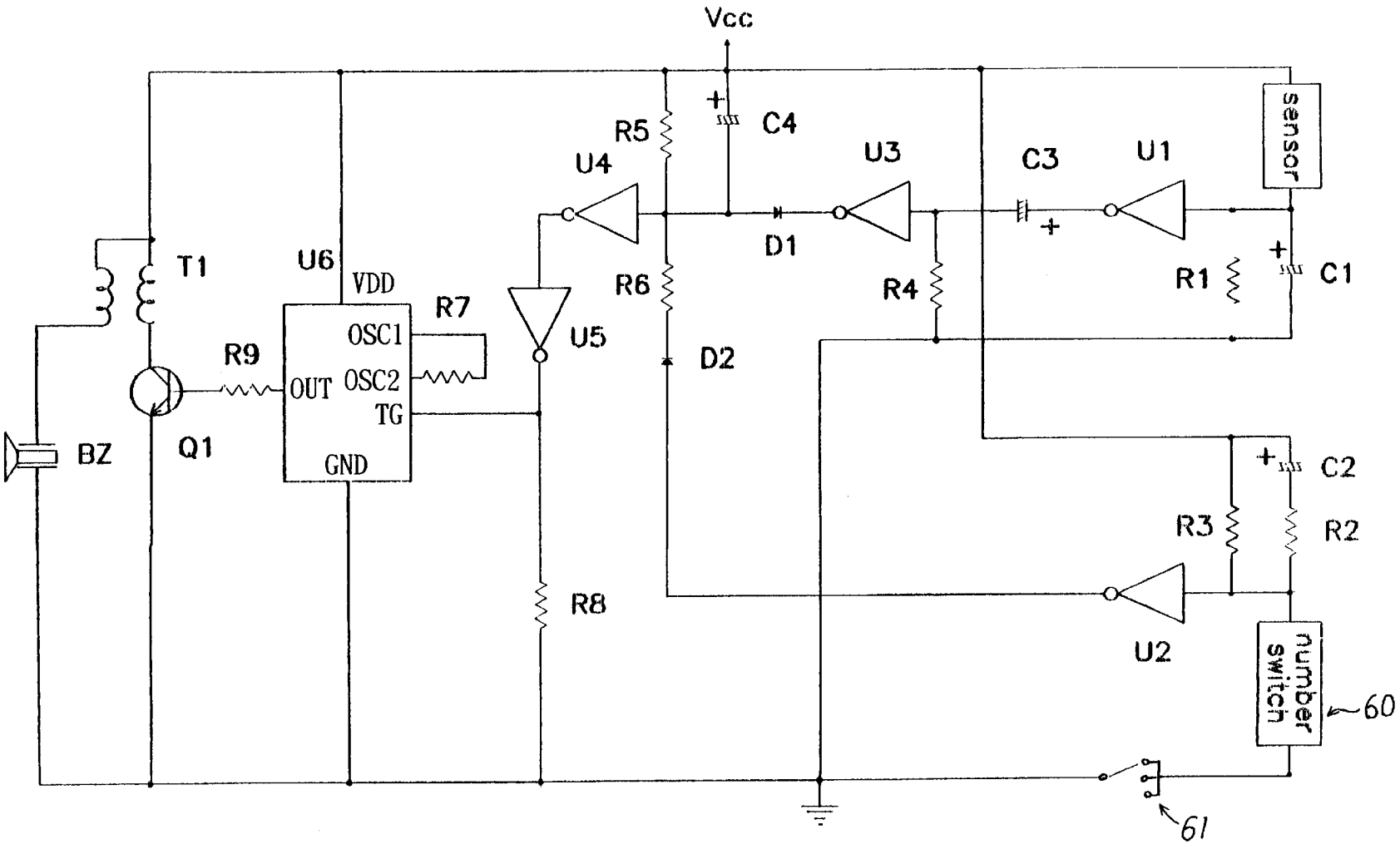
FIG. 7 is a circuit diagram of an alarm of the theftproof lock device for a suitcase in accordance with a preferred embodiment of the present invention.

As shown in FIG. 7, the circuit diagram of the alarm is shown and is illustrated as follows.

1. When the circuit is closed, the number switch presents a short state. Thus, U2 has an input terminal that is grounded, and an output terminal that may output a high voltage through D2 and R6 to U4, thereby suppressing the signal sent from the vibration switch.

2. When the circuit is started, the number switch presents an opened state. At this time, R2 and C2 may form a delay circuit, so that U2 may delay three seconds to send a low voltage to eliminate the suppression signal. At this time, when the vibration switch is operated, the signal may enter U6 conveniently.

3. When the vibration switch is triggered after the circuit is opened, the signal may be delayed three seconds by R1 and C1, and R4 and C4, and may then be sent to U3 to start the timing circuit (R2 and C2). At this time, U6 may obtain the triggered signal sent from U4 and U5 to produce an alarm, and C4 and R5 will count two minutes, so that the alarm may be stopped during two minutes, and may return to the alarming state.

4. When the circuit is closed, the number switch presents a short state. Thus, U2 has an input terminal that is grounded, and R2 and C2 may form a delay circuit, so that U2 may delay three seconds to send a high voltage through D2 and R6 to U4, thereby suppressing the signal sent from the vibration switch.

When the number wheel of each of the multiple number wheel sets is rotated to the correct position, the switch is short, and the alarm is closed. When the number wheel of each of the multiple number wheel sets is rotated to the incorrect position, the switch is opened, and the alarm is started. Thus, when the theftproof lock device in accordance with a preferred embodiment of the present invention is vibrated by an external force, the vibration switch is started, so that the alarm will produce an alarm, thereby providing a theftproof effect. In addition, when the vibration switch is started, the alarm will delay three seconds to alarm, so that the user has enough time to release the alarm.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A theftproof lock device for a suitcase, comprising a housing, a closure plate mounted on an opened side of the housing, and further comprising multiple number wheel sets, two opposite press members, a drive plate, a slide, and a circuit board each mounted between the housing and the closure plate, wherein:

the circuit board is secured on one side of the closure plate, and is provided with at least one number switch which includes a first conductive plate and a second conductive plate, the at least one number switch is connected with a switch conductive plate set which is electrically connected with an alarm; and the housing has an upper portion for receiving the two opposite press members, the slide is movably mounted between the two opposite press members, the housing has a lower portion provided with multiple protruding shafts for mounting the multiple number wheel sets, each of the multiple number wheel sets includes a number wheel and a control wheel in turn mounted on a respective one of the multiple protruding shafts of the housing, the control wheel has a first side formed with multiple cavities, the number wheel is provided with multiple bosses that may be inserted into and locked in the multiple cavities of the control wheel, so that the number wheel may drive the control wheel to rotate, the control wheel has a second side provided with a spring which is rested on the first conductive plate of the number switch of the circuit board, the second side of the control wheel is provided with a boss that may contact the second conductive plate of the number switch of the circuit board, the boss is conducted with the spring, the control wheel has an outer periphery formed with a breach located opposite to the boss, the drive plate is mounted between the multiple number wheel sets and the closure plate, the drive plate is formed with multiple oblong slots for receiving the multiple control wheels of the multiple number wheel sets, and each of the multiple oblong slots of the drive plate is provided with a lug that may be inserted into and locked in the breach of the respective control wheel.

2. The theftproof lock device for a suitcase in accordance with claim 1, wherein the alarm is provided with a vibration switch.

3. The theftproof lock device for a suitcase in accordance with claim 1, wherein the housing has a top formed with two spaced insertion trenches each extending into the inside of the housing, and each of the two opposite press members is provided with a locking hook that may extend into and close the respective insertion trench of the housing.

4. The theftproof lock device for a suitcase in accordance with claim 1, wherein the drive plate has a top formed with a recess that is provided with an inclined face.

5. The theftproof lock device for a suitcase in accordance with claim 4, wherein the slide has a center formed with a passage slot for receiving a spring, and the slide has a bottom provided with a wedge that may be inserted into and locked in the recess of the drive plate.

* * * * *